US009175875B1

(12) United States Patent
Beiler et al.

(10) Patent No.: US 9,175,875 B1
(45) Date of Patent: Nov. 3, 2015

(54) USED OIL FURNACE WITH VERTICAL FLUE TUBES

(75) Inventors: Benuel J. Beiler, Narvon, PA (US); Kevin J. Southam, Gordonville, PA (US)

(73) Assignee: Clean Energy Heating Systems, LLC, Honey Brook, PA (US)

( * ) Notice: Subject to any disclaimer, the term of this patent is extended or adjusted under 35 U.S.C. 154(b) by 862 days.

(21) Appl. No.: 13/357,382

(22) Filed: Jan. 24, 2012

(51) Int. Cl.
*F24H 3/08* (2006.01)

(52) U.S. Cl.
CPC ..... *F24H 3/08* (2013.01)

(58) Field of Classification Search
CPC ..... F24B 7/20; F24H 1/287; F24H 3/065; F24H 3/08; F24H 3/087
USPC ..... 126/99 R–99 D, 99 A, 109, 104 R; 237/12.3 C, 48, 53
See application file for complete search history.

(56) References Cited

U.S. PATENT DOCUMENTS

| | | | | | |
|---|---|---|---|---|---|
| 1,613,615 | A | * | 1/1927 | Lippert | 126/116 R |
| 2,543,201 | A | * | 2/1951 | Rifley | 126/110 R |
| 2,556,170 | A | * | 6/1951 | Davidson | 126/101 |
| 2,568,487 | A | * | 9/1951 | Carswell | 126/110 R |
| 2,737,173 | A | | 3/1956 | Hauck | |
| 3,120,225 | A | * | 2/1964 | Stark et al. | 126/110 AA |
| 3,128,756 | A | * | 4/1964 | Galvin | 126/116 R |
| 3,133,527 | A | * | 5/1964 | Mizer | 122/136 R |
| RE27,396 | E | * | 6/1972 | Hemmert | 432/223 |
| 3,822,991 | A | * | 7/1974 | Mutchler | 432/223 |
| 3,835,816 | A | * | 9/1974 | Ferrin | 122/156 |
| 4,477,019 | A | * | 10/1984 | Breitbach | 236/10 |
| 4,794,908 | A | * | 1/1989 | Hall | 126/112 |
| 4,860,725 | A | * | 8/1989 | Tallman et al. | 126/110 R |
| 4,924,848 | A | * | 5/1990 | Vaughn | 126/110 AA |
| 4,955,359 | A | | 9/1990 | Briggs | |
| 5,363,836 | A | | 11/1994 | Briggs | |
| 5,992,410 | A | * | 11/1999 | Raleigh et al. | 126/110 AA |
| 6,694,968 | B1 | | 2/2004 | Dienner | |
| 2005/0050755 | A1 | * | 3/2005 | Majima | 34/218 |

* cited by examiner

*Primary Examiner* — Jorge Pereiro
(74) *Attorney, Agent, or Firm* — Miller Law Group, PLLC

(57) ABSTRACT

The combustion gases in a used oil furnace are discharged from the combustion chamber through an opening in the upper rear portion of the combustion chamber to direct the combustion gases into an upper header. An array of vertically oriented flue tubes extends downwardly from the upper header to a lower header before being discharged through horizontally opposing discharge openings. Ventilation air is blown into the rear of the furnace past and around the vertical flue tubes and is then forced in to a laminar path extending circumferentially around the combustion chamber by an air sweep shroud spaced from the combustion chamber by an annular gap. The ventilation air is then collected in a forward discharge chamber for discharge through louvered ventilators into the adjacent ambient atmosphere.

18 Claims, 11 Drawing Sheets

USED OIL FURNACE WITH VERTICAL FLUE TUBES

FIELD OF THE INVENTION

This invention relates generally to furnaces for the burning of used oil and, more particularly, to the construction of the furnace to direct the flow of the exhaust gasses generated from the combustion of used oil within the furnace to enhance the efficiency of the operation of the furnace to heat an ambient medium such as ventilation air.

BACKGROUND OF THE INVENTION

Used oil furnaces are similar to standard oil burning furnaces, but have been adapted to handle oil products that have been previously used in a traditional lubricating operation, such as used crankcase oil up to 50 SAE, used transmission fluid, and even #2, #4 and #5 fuel oils. Such oil products can have significantly varying viscosities and significantly varying burning characteristics, as well. Typically, used oil products are collected into a tank to be supplied to the furnace from a single source.

The burner nozzle combines a flow of compressed air with the flow of preheated used oil to atomize the used oil and inject a stream of compressed air and atomized used oil droplets into the combustion chamber of the furnace where it is ignited to create a flame and provide a heat source. Known used oil furnace burner nozzles utilize an in-line burner nozzle configuration coupled directly to the front door of the multi oil furnace.

The structural configuration of the furnace is important in the efficiency of the operation of the furnace. A flame target at the end of the combustion chamber opposite the burner nozzle is provided to contain the flame created within the combustion chamber. An exit for the exhaust gases, sometimes referred to flue gases or combustion gases, is typically provide for exhaust of the combustion gases from the combustion chamber. The combustion gases are directed out of the furnace for discharge to the atmosphere. Known furnace configurations utilize conduits to redirect the combustion gases through a serpentine path to the side of the combustion chamber before discharging the gases from the furnace. The serpentine path allows ventilation air to be moved around the conduits to absorb heat therefrom before being discharged into the ambient atmosphere where heating is desired.

Another furnace configuration is disclosed in U.S. Pat. No. 5,531,212, granted to Benjamin K. Smoker, et al., on Jul. 2, 1996, in which the combustion gases are directed through horizontally disposed upper and lower banks of exhaust conduits oriented parallel to and around the combustion chamber. The combustion gases are directed through an outlet at the rear of the combustion chamber into the upper bank of horizontal conduits which is connected to a header at the front end of the combustion chamber and then directed into the lower bank of conduits, which are connected to an exhaust header that directs the combustion gases through a discharge opening and away from the furnace.

In U.S. Pat. No. 6,694,968 granted to Jacob Dienner, et al, on Feb. 24, 2004, the exhaust tubes are arranged in a horizontal circular pattern at the end of the combustion chamber in a manner that the exhaust tubes are spaced apart and connected to a rear header that directs the combustion gases to a pair of opposing discharge openings for discharge of the combustion gases from the furnace. Ventilation air is blown into the furnace housing by a blower mounted at the rear of the furnace housing to direct the ventilation air through a central annular opening in the rear header to exit the rear header in the center of the circular array of exhaust tubes. The ventilation air then passes around the exhaust tubes that then around the combustion chamber to be discharged at the front of the furnace housing into the room in which the furnace is supported. A major disadvantage of the used oil furnace configuration disclosed in U.S. Pat. No. 6,694,968 is the required length of the furnace housing required to contain the combustion chamber and the exhaust conduit array behind the combustion chamber.

A different exhaust conduit configuration is found in U.S. Pat. No. 5,363,836 granted on Nov. 15, 1994, to Eugene C. Briggs in which the exhaust gases are directed from the rear of the combustion chamber into a flat header located within the furnace housing above the combustion chamber. Ventilation air is blown from the rear of the furnace housing to mover around the flat header and around the combustion chamber before being discharged into the room through discharge openings at the front of the furnace housing. A more compact furnace housing is disclosed in U.S. Pat. No. 4,955,359 granted on Sep. 11, 1990, to Eugene C. Briggs, et al., in which the combustion gases are collect from the rear off the combustion chamber into a vertically oriented exhaust header around which ventilation air is passed to collect heat therefrom before passing around the combustion chamber and exiting the discharge openings at the front of the furnace housing.

A vertical array of exhaust tubes is disclosed in U.S. Pat. No. 2,737,173, issued to Roy C. Hauck, et al., on Mar. 6, 1956. The Hauck exhaust conduits are oriented above the combustion chamber and collect combustion gases directly from an opening at the top of the combustion chamber. The Hauck combustion gases pass through the vertical array of exhaust conduits that direct the combustion gases into a horizontally disposed discharge opening. Ventilation air is passed around the vertical exhaust conduits and around the combustion chamber by a fan and then discharged into the ambient air around the furnace.

It would also be desirable to provide a used oil furnace configuration that provides a compact configuration that efficiently directs ventilation air around the exhaust conduits and around the combustion chamber to collect heat therefrom before being discharged into the room in which the furnace is mounting.

SUMMARY OF THE INVENTION

It is an object of the invention to overcome the disadvantages of the prior art by providing a used oil furnace having a horizontally oriented combustion chamber that discharges combustion gases into a vertical flue tube array to direct the combustion gases downward to discharge openings while ventilation air is blown around the flue tubes and around the combustion chamber to collect heat therefrom.

It is another object of this invention to provide a used oil furnace configuration in which the combustion chamber is surrounded by an air sweep shroud spaced from the combustion chamber by an annular gap to direct ventilation air along a laminar flow along the length of the combustion chamber until reaching a discharge header at the front of the furnace housing.

It is an advantage of this invention that the combustion gases are directed through a flow path defined by exhaust tubes from which ventilation air can extract heat from the combustion gases.

It is a feature of this invention that the flue tubes are arranged in a vertically oriented array located at the rear of the combustion chamber.

It is another feature of this invention that the vertical flue tubes are located in a ventilation chamber at the rear of the furnace housing in direct line of the discharge of the ventilation air fan.

It is still another feature of this invention that the flow path of the combustion gases exits the combustion chamber at an opening at the upper rear portion of the combustion chamber to direct the combustion gases into a header in which the flue tubes extend downwardly therefrom.

It is another advantage of this invention that the rearward location of the ventilation chamber for the vertical flue tubes allows heat to be extracted from the combustion gases before the ventilation air is passed around the combustion chamber.

It is still another advantage of this invention that the flow path of the combustion gases extends downwardly through the vertical flue tubes into a bottom header to which horizontally opposing discharge openings are located, forcing the combustion gases to make a ninety degree turn from the vertical flue tubes to exit the furnace housing.

It is yet another advantage of this invention that the ninety degree turn forced on the combustion gases occurs after the ventilation air has extracted heat therefrom, thus facilitating the precipitation of ash or other debris from the combustion gases within the bottom header before being discharged from the furnace.

It is a further advantage of this invention that the deposit of ash and other debris precipitated from the combustion gases in the bottom header where the discharge openings are located facilitates the periodic cleaning of ash and debris from the bottom header.

It is yet another feature of this invention that the combustion chamber has an air sweep shroud surrounding the rearward portion thereof to direct the flow of ventilation air around the combustion chamber.

It is still another feature of this invention to provide a furnace construction that will incorporate a 360.degree flow path around the combustion chamber for the efficient transfer of heat from the combustion chamber to the flow of ventilation air.

It is still a further advantage of this invention that the flow path for the ventilation air is forced around and against the exterior surface of the combustion chamber in a laminar flow path extending circumferentially around the combustion chamber to extract heat therefrom before being discharged from the furnace housing.

It is still another object of this invention to provide a used oil furnace which is durable in construction, inexpensive of manufacture, carefree of maintenance, facile in assemblage, and simple and effective in use.

These and other objects, features, and advantages are accomplished according to the instant invention by providing a used oil furnace in which the combustion gases are discharged from the combustion chamber through an opening in the upper rear portion of the combustion chamber to direct the combustion gases into an upper header. An array of vertically oriented flue tubes extends downwardly from the upper header to a lower header before being discharged through horizontally opposing discharge openings. Ventilation air is blown into the rear of the furnace past and around the vertical flue tubes and is then forced in to a laminar path extending circumferentially around the combustion chamber by an air sweep shroud spaced from the combustion chamber by an annular gap. The ventilation air is then collected in a forward discharge chamber for discharge through louvered ventilators into the adjacent ambient atmosphere.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
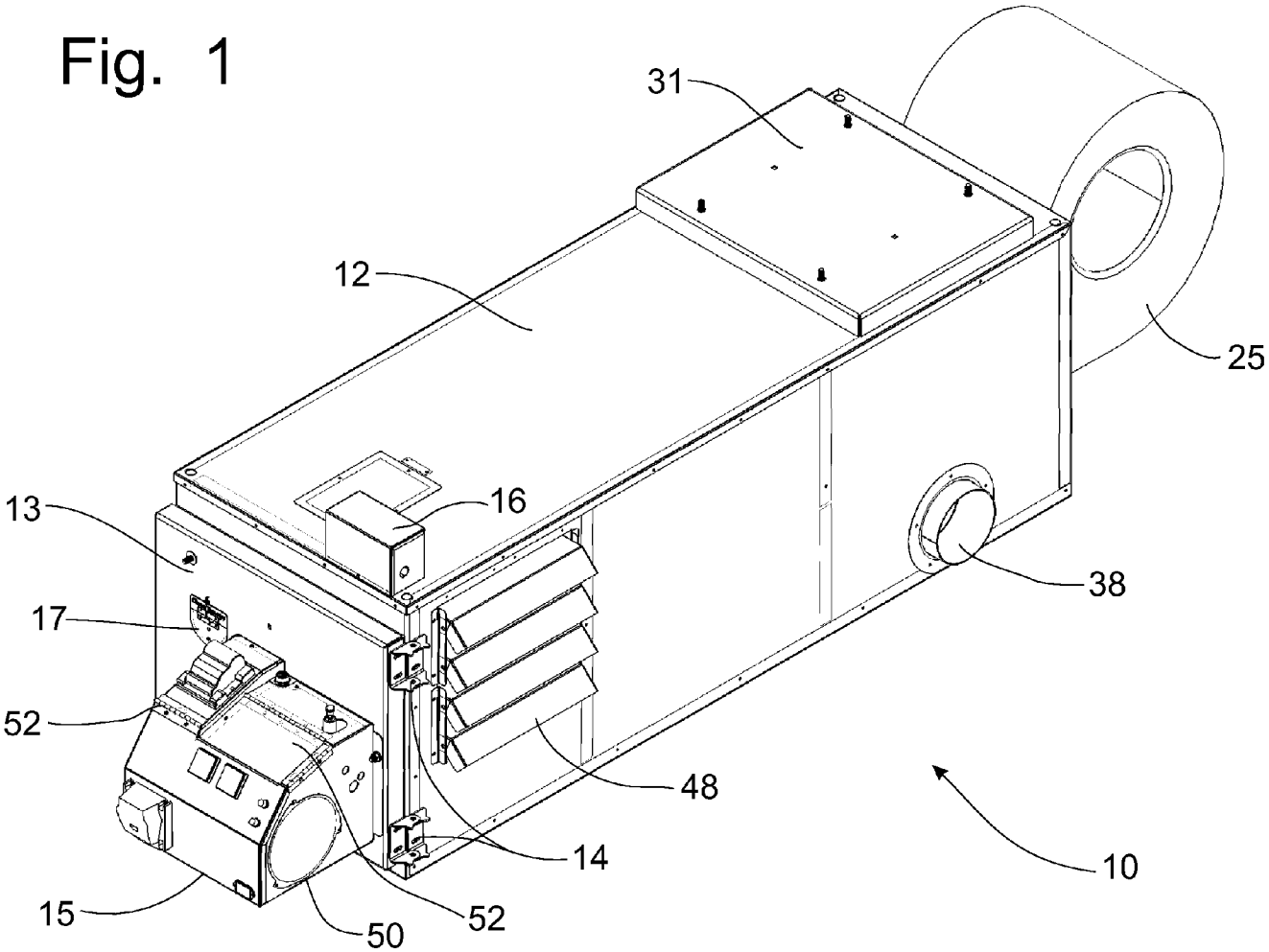
FIG. 1 is a front, right perspective view of the used oil furnace incorporating the principles of the instant invention, the ventilation fan being schematically depicted at the rear of the furnace housing to blow ventilation air through the furnace housing.
Figure 2:
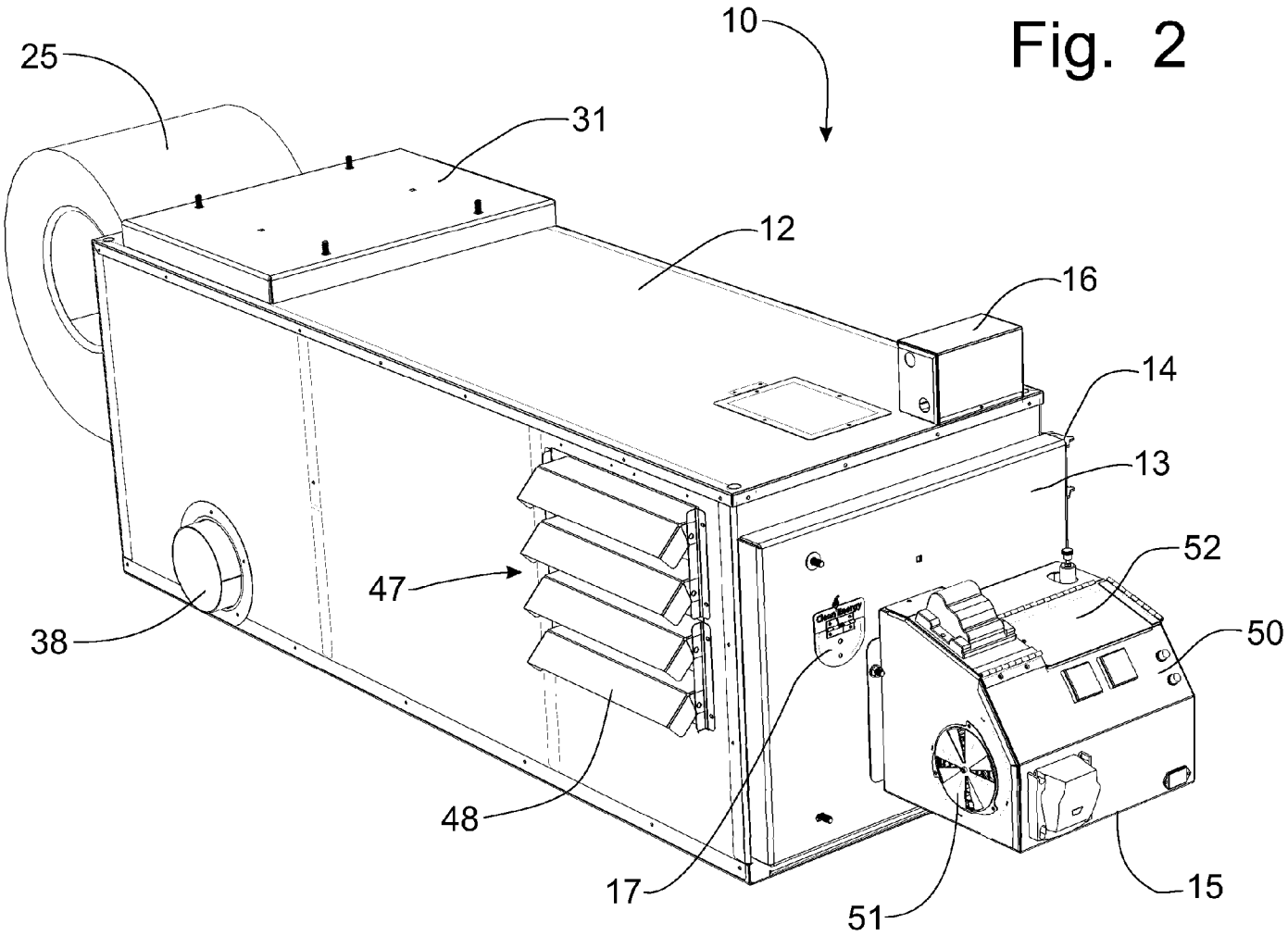
FIG. 2 is a front, left perspective view of the used oil furnace depicted in FIG. 1.
Figure 3:
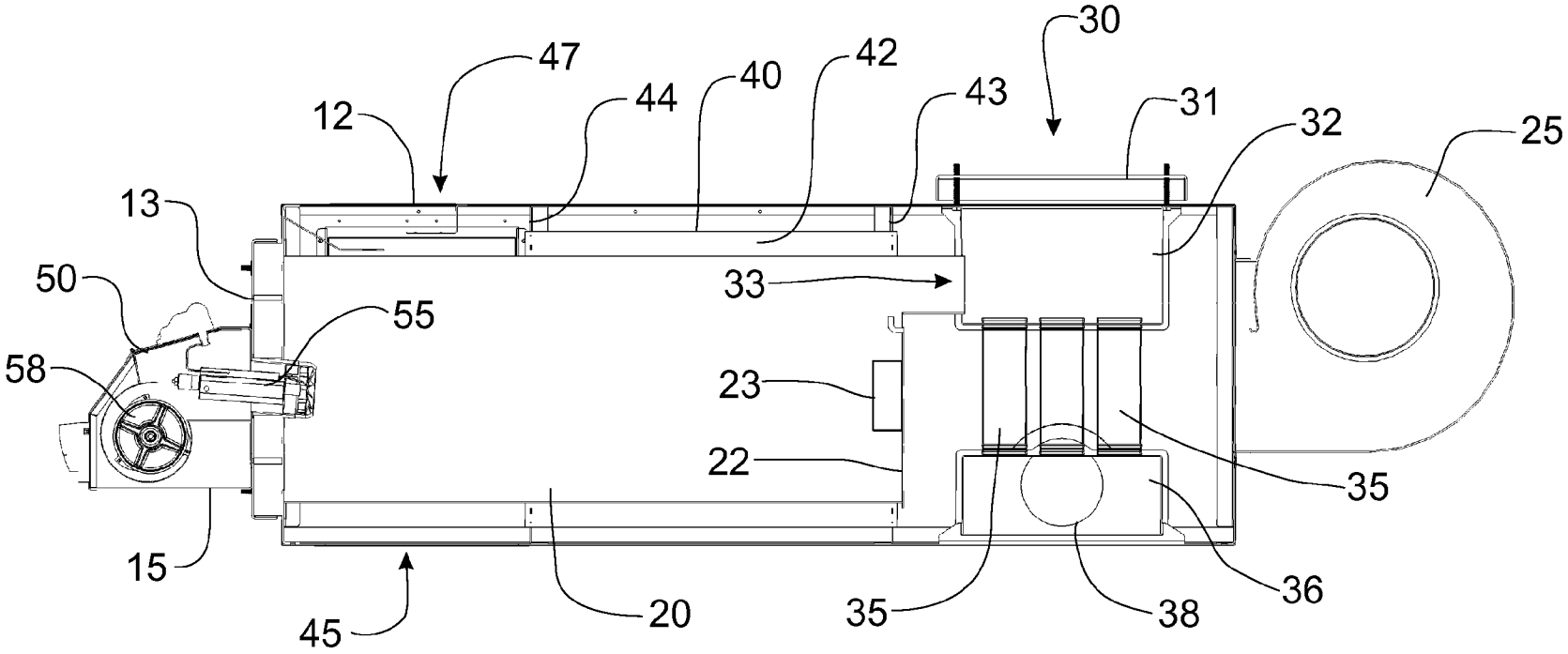
FIG. 3 is a cross-sectional view of the furnace housing taken along a vertical plane passing through the longitudinal center of the furnace housing, the vertical flue tubes being shown in the ventilation chamber at the rear of the furnace housing.
Figure 4:
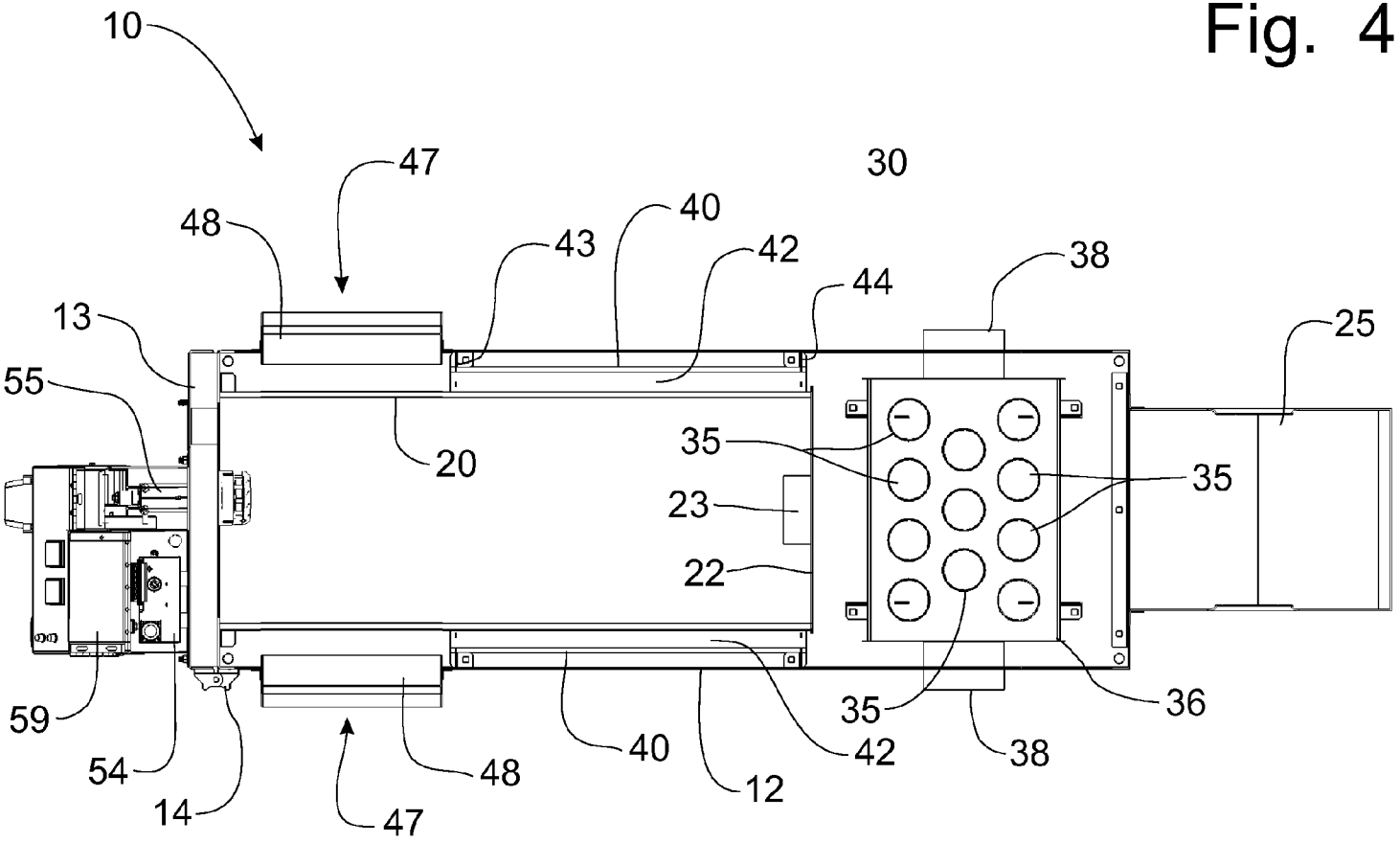
FIG. 4 is a cross-sectional view of the furnace housing taken along a horizontal plane passing longitudinally through the furnace housing, the vertical flue tubes being shown at the rear of the furnace housing.
Figure 5:
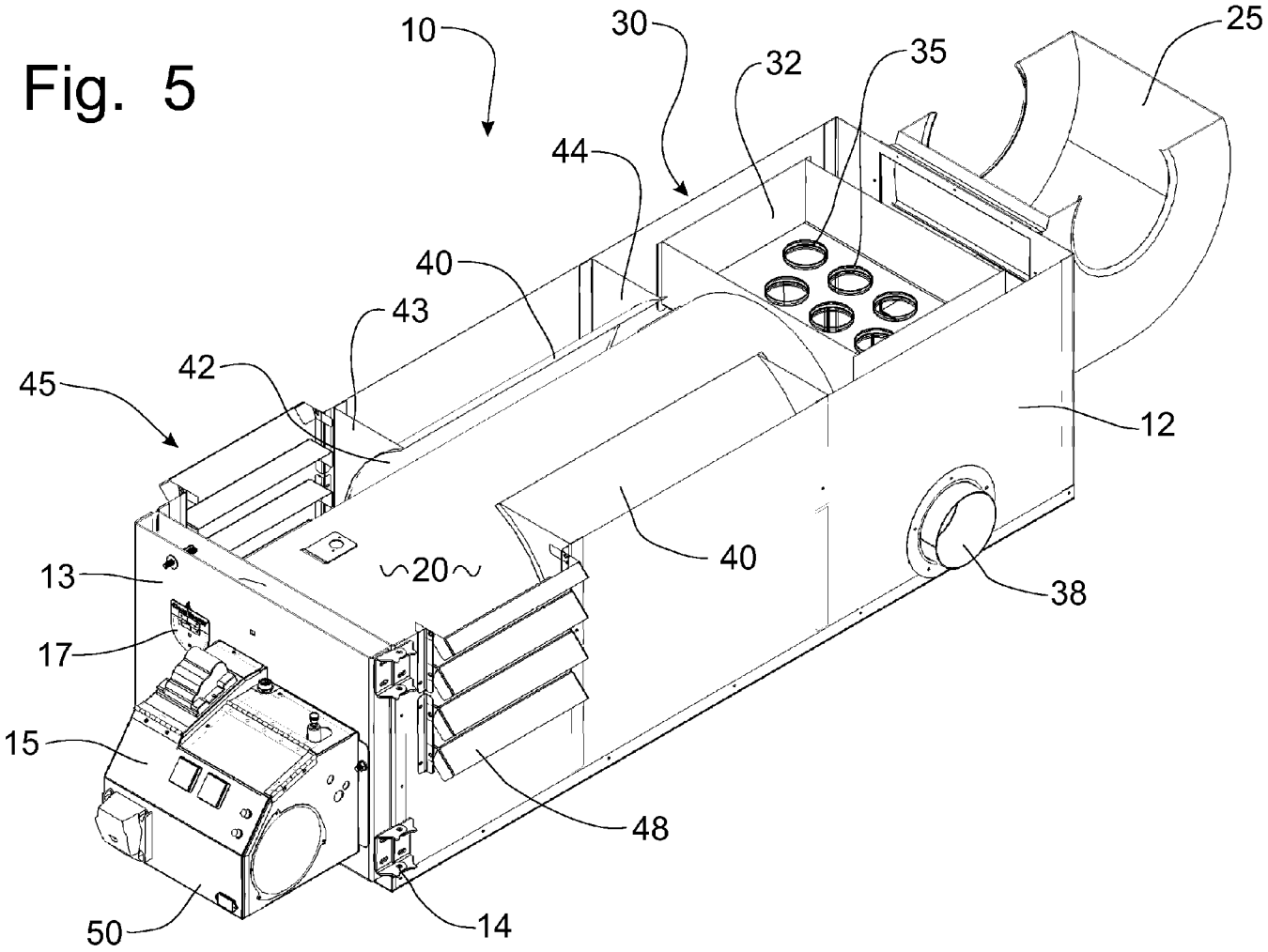
FIG. 5 is a cross-sectional perspective view of the furnace housing taken along a horizontal plane passing longitudinally through the furnace housing and intersecting the upper header to show the connection of the vertical flue tubes thereto, the air sweep shroud surrounding the rearward portion of the combustion chamber being partially broken away above the combustion chamber to depict the annular gap separating the air sweep shroud and the exterior surface of the combustion chamber.
Figure 6:
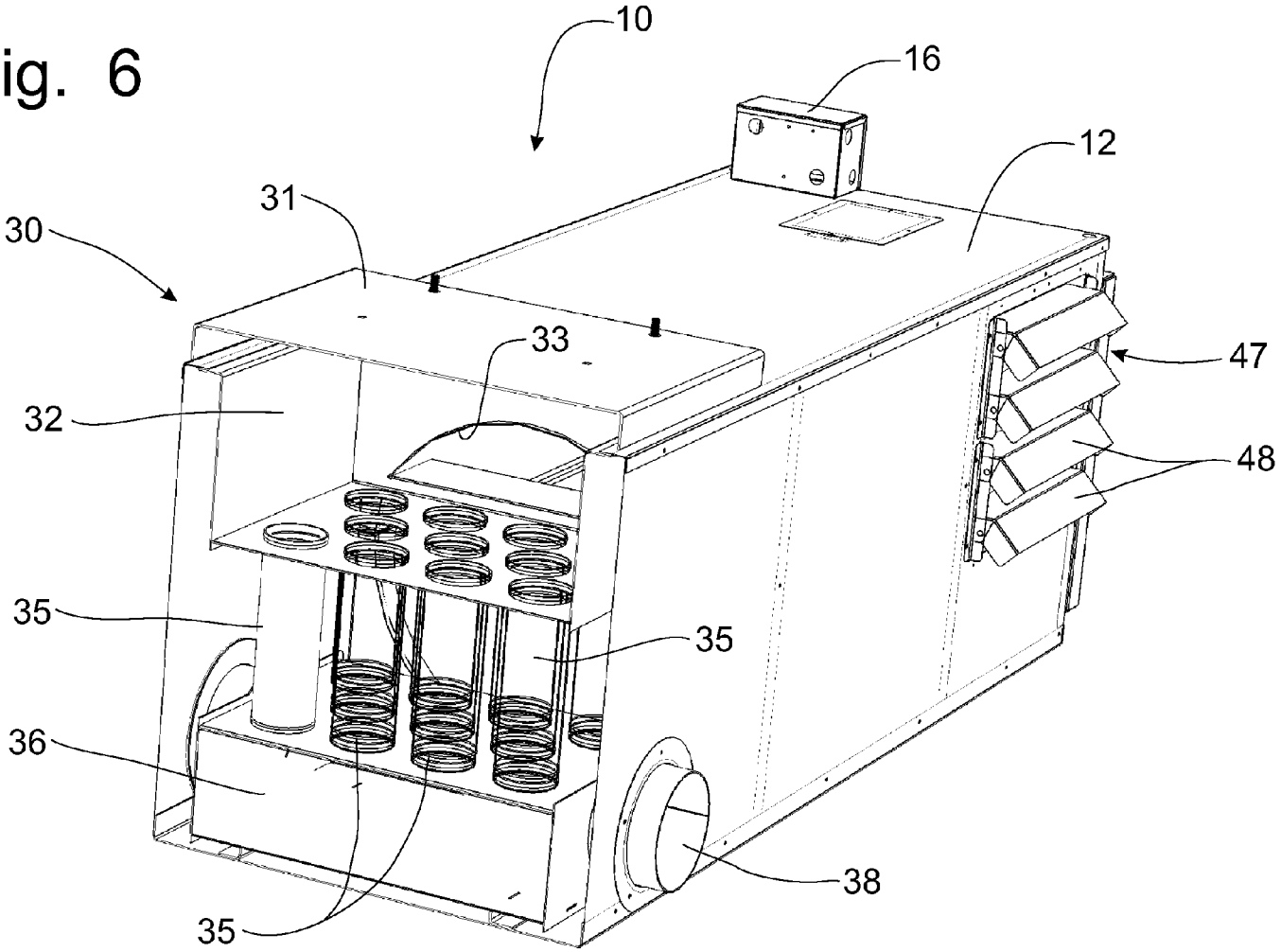
FIG. 6 is a cross-sectional view of the furnace housing taken along a vertical plane oriented perpendicularly to the longitudinal axis of the furnace housing, the vertical plane passing through the rear ventilation chamber to shown the upper header and vertical flue tubes interconnecting the upper and lower headers.
Figure 7:
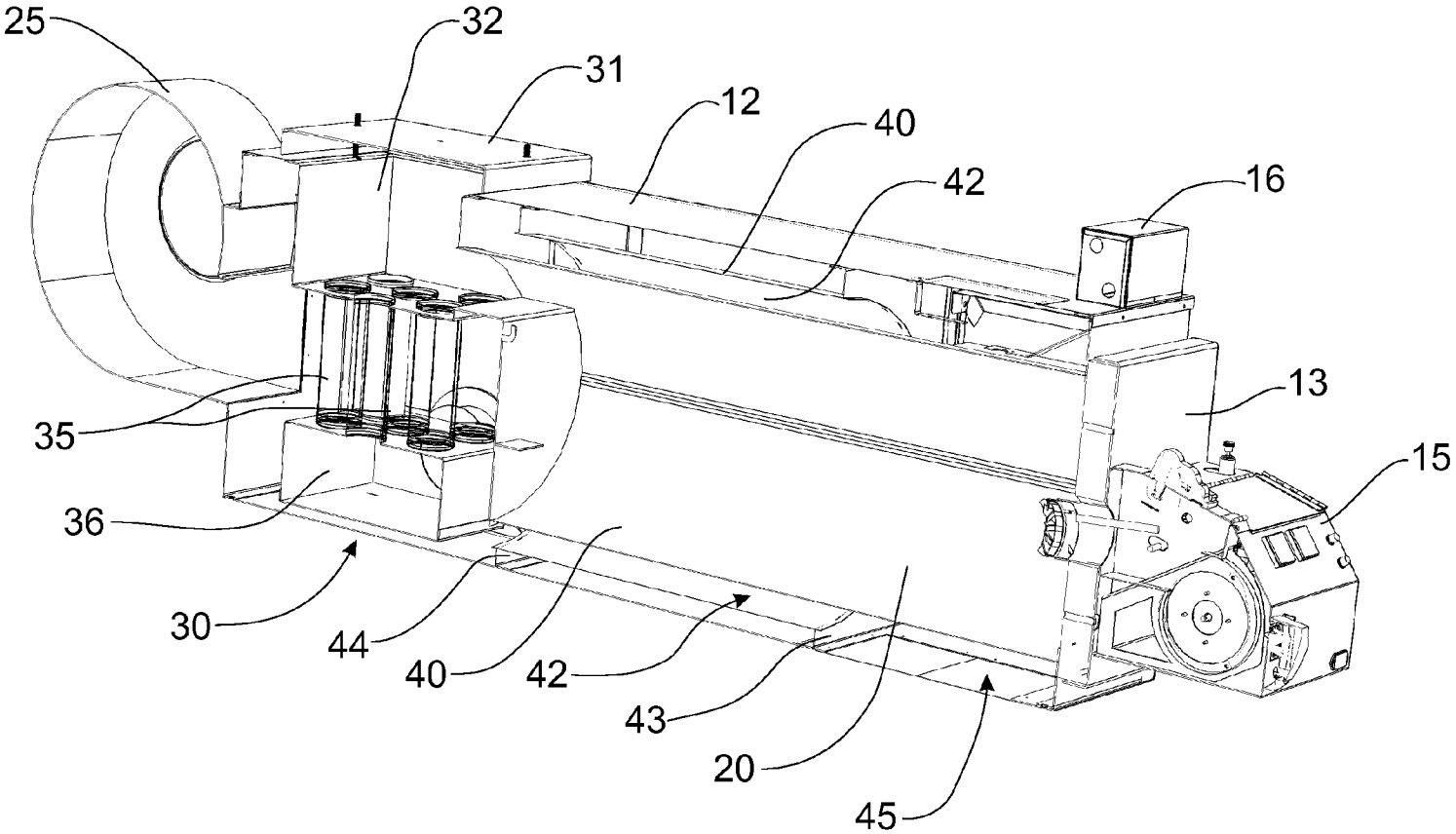
FIG. 7 is a cross-sectional perspective view of the furnace housing taken along a vertical plane passing through the longitudinal centerline of the furnace housing, the perspective view being oriented from the front, left side of the furnace housing.
Figure 8:
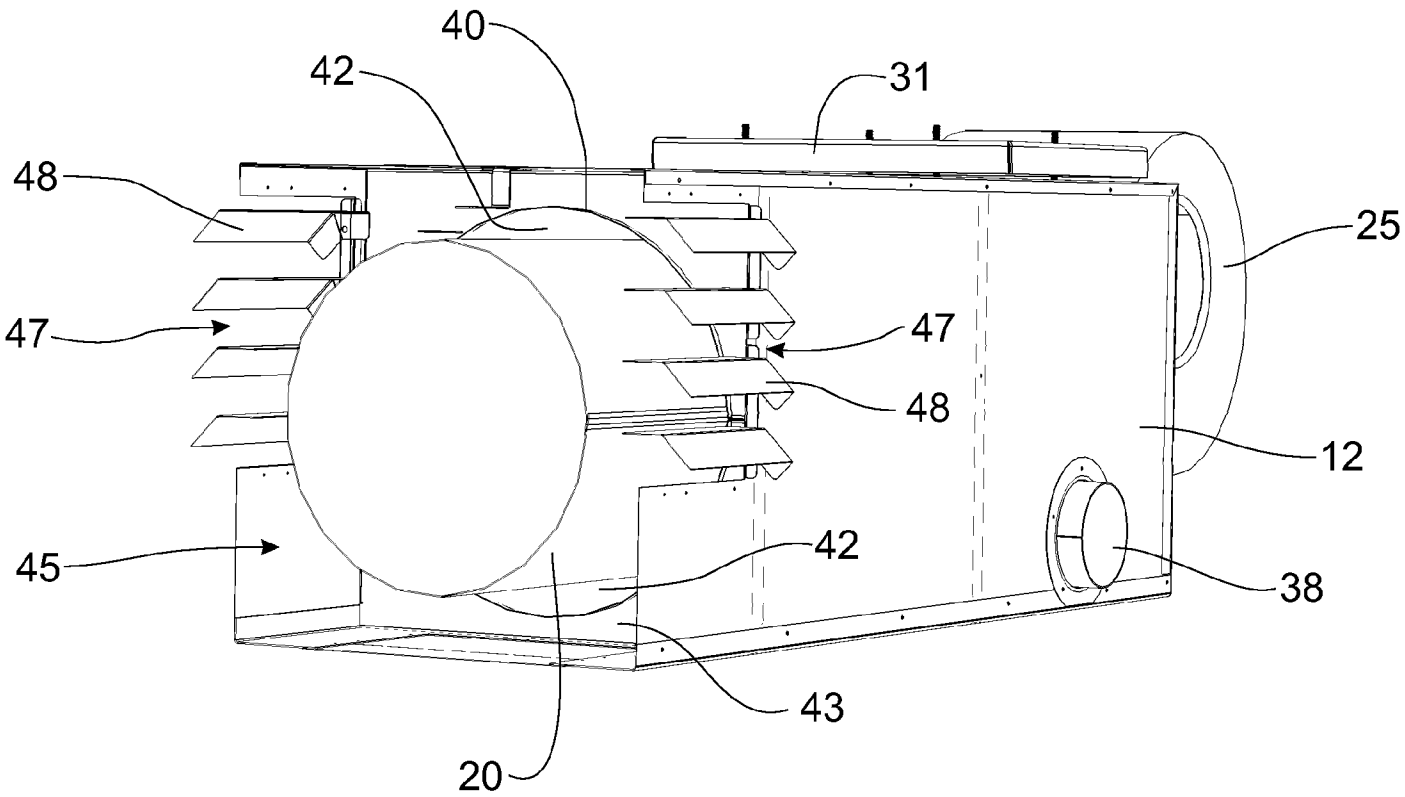
FIG. 8 is a cross-sectional view of the furnace housing taken along a vertical plane oriented perpendicular to the longitudinal axis of the furnace housing, the vertical plane passing through the front ventilation chamber.

Referring now to FIGS. 1-8, a used oil furnace incorporating the principles of the instant invention can best be seen. Any left and right references used herein are determined by standing at the front of the furnace facing the burner housing mounted on the front access door. While the typical installation of a used oil furnace incorporating the principles of the instant invention is from the ceiling of a structure, such as a garage, the furnace 10 can be placed on a stable support surface, such as a floor, where heated air is desired. Accordingly, the furnace housing or cabinet shell 12 can be provided with a plurality of connector mounts (not shown) in the top surface thereof for engagement with conventional threaded rods to suspend the furnace 10 from an elevated structure (not shown).

The cabinet shell 12 of the multi-oil furnace 10 has a front door 13 on which is mounted a burner assembly 15 for pivotal movement with the pivotal movement of the front access door 13. The servicing of the burner assembly 15 is accomplished through hinged access panels 52 on the burner housing 50 and by opening the front access door 13. The front access door 13 of the cabinet shell 12 is also pivotally mounted on the cabinet shell 12 by hinges 14 to permit the opening of the front door 13 for service and cleaning of the combustion chamber 20 and the burner assembly 15. The combustion chamber 20 is generally cylindrical in shape and terminates at a back wall 22 on which is mounted a cupped ceramic target 23 to deflect the combustion gases outwardly around the edges of the target 23 to double back around the flame generated by the burner assembly 15. The net result is that a greater burning efficiency is accomplished before the combustion gases are drawn out of the combustion chamber 20 into the heat exchanger 30.

A supply of used oil is fed to the burner assembly 15 from a remote storage container (not shown) in a conventional manner through conduits (not shown) that provide a flow of used oil to the burner assembly 15, as will be described in greater detail below. Also, combustion air is blown into the combustion chamber 20 by a combustion fan 58, shown in FIGS. 10 and 11 and described in greater detail below. Electrical current is supplied to a distribution box 16 mounted on top of the cabinet shell 12 which provides electrical current to operate a preheater block 54 and to provide a spark for igniting the flow of used oil to create the flame fired into the combustion chamber 20, as will also be described in greater detail below. The cabinet shell 12 also provides a port with a hinged cover 17 to allow an operator to look into the combustion chamber 20 while the burner assembly 15 is operating to check on the qualities of the flame being produced and the operation of the burner assembly 15.

The heat exchanger 30 is constructed with an upper header 32 a lower header 36 and a plurality of separate vertical flue tubes 35 interconnecting the upper and lower headers 32, 36. The upper header 32 is connected to the combustion chamber 20 through an exhaust port 33 that allows the heated and rising combustion gases generated in the combustion chamber 20 from the creation of the flame ignited at the burner assembly 15 and directed at the target 23 to flow out of the combustion chamber 20 and into the upper header 32. The combustion gases then travel downward through the vertical flue tubes 35 into the lower header 36. A discharge opening 38 is connected on each transverse side of the lower header 36 to connect the lower header to a chimney (not shown) for a conventional discharge of the combustion gases from the furnace 10. To facilitate cleanout of the upper header 32, an access door 31 is supported on the cabinet shell 12 above the upper header 32.

Heat contained within the combustion gases can be extracted within the heat exchanger 30 by ventilation air being blown through the heat exchanger 30 by a ventilation fan 25 mounted on the rear of the cabinet shell 12. The vertical flue tubes 35 are arranged in an array that separates the flue tubes 35 from one another to allow for the flow of ventilation air around and between the individual flue tubes 35. Thus, the ventilation air will contact the vertical flue tubes 35, as well as portions of the upper and lower headers 32, 36 to absorb heat from the combustion gases flowing with the flue tubes 35, and upper and lower headers 32, 36.

The cabinet shell 12 supports an air sweep shroud 40 surrounding the rearward portion of the combustion chamber 20. The air sweep shroud 40 is concentric with the combustion chamber 20 and separated therefrom by an annular gap 42. The air sweep shroud 40 is supported from a front wall 43 and a rear wall 44 that block the cabinet shell 12 at an intermediate point along the combustion chamber 20 and at the rear of the combustion chamber 20, respectively, to leave an annular ring 42, corresponding to the annular gap, around the combustion chamber 20. The partially heated ventilation air passing through the heat exchanger 30 is then forced to flow through the annular ring 42 circumferentially surrounding the combustion chamber 20 in a laminar flow path next to the combustion chamber 20 to collect heat therefrom. Thus, the ventilation air, which is partially heated by flowing through the heat exchanger 30, continues to collect heat from the rearward end of the combustion chamber 20 where the combustion gases are collecting before moving through the exhaust port 33.

The ventilation air is then discharged from the annular ring 42 through the front wall 43 into the front ventilation chamber 45 surrounding the combustion chamber 20 which passes through the center of the ventilation chamber 45. The ventilation air can then escape from the cabinet shell 12 by passing through the louvered ventilation openings 47 on the opposing transverse sides of the cabinet shell 12. The heated ventilation air exiting the ventilation openings 47 will then heat the ambient air in the room in which the furnace 10 is mounted. The direction and flow of the heated ventilation air can be controlled through manipulation of the louvers 48 associated with the ventilation openings 47 in a conventional manner.

Figure 10:
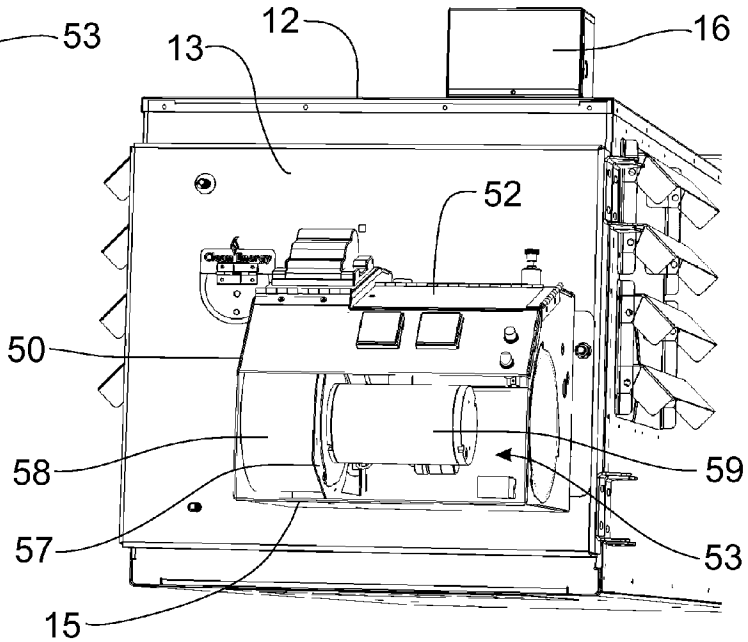
FIG. 10 is also a cross-sectional view of the burner housing similar to that of FIG. 9, but taken forwardly of the combustion air fan.
Figure 9:
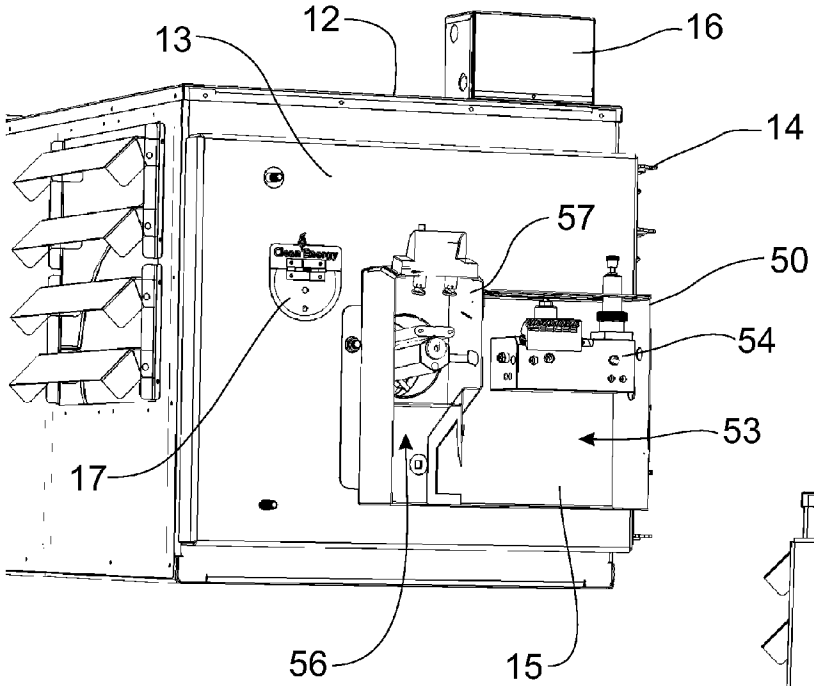
FIG. 9 is a cross-sectional view of the burner housing taken along a vertical plane perpendicular to the longitudinal axis of the furnace housing with the vertical plane being positioned behind the combustion air fan.
Figure 11:
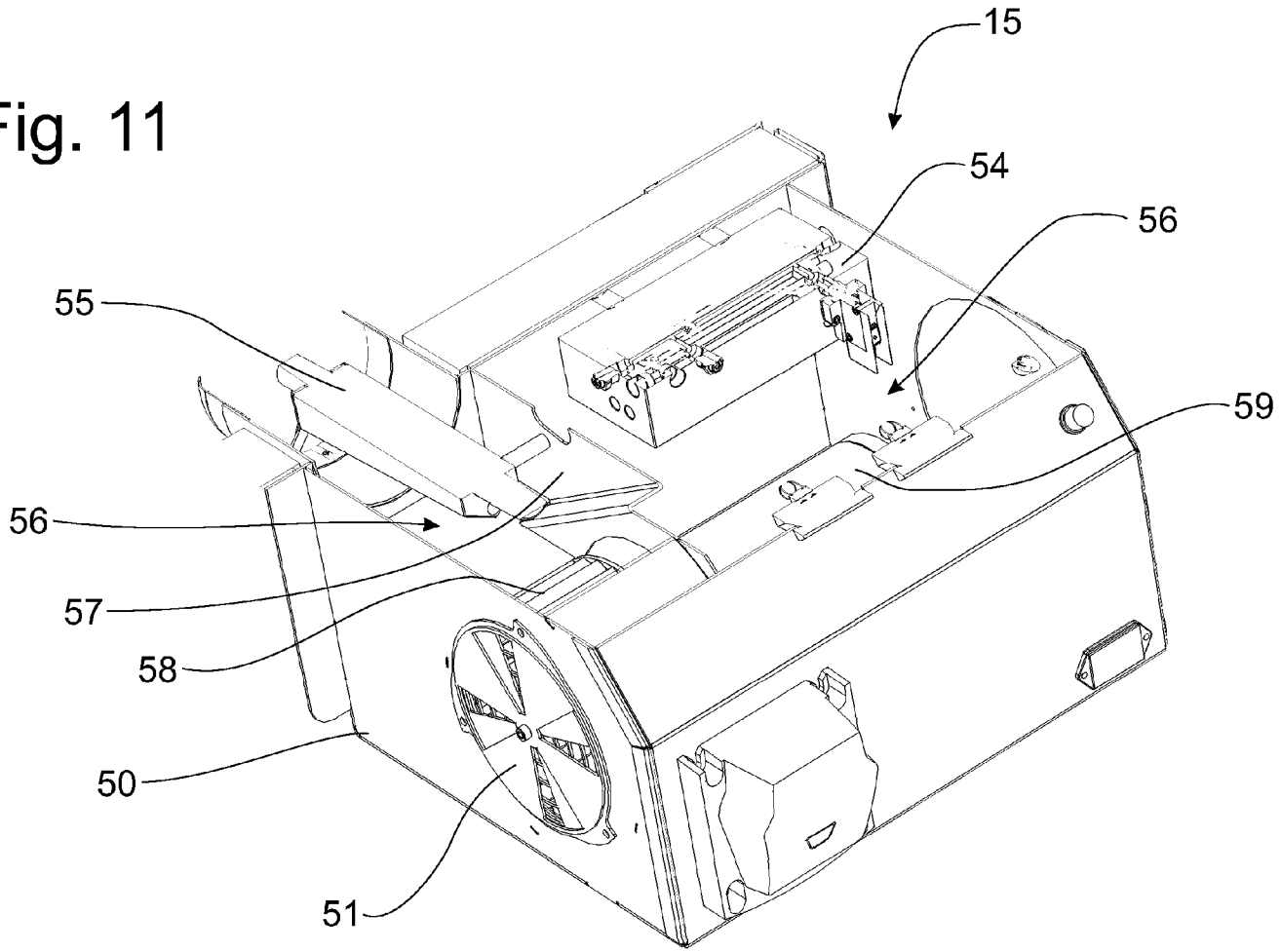
FIG. 11 is an enlarged cross-sectional view of the burner housing taken along a horizontal plane passing above the combustion air fan.

Referring now to FIGS. 9-11, the details of the burner assembly 15 can best be seen. The burner assembly 15 is supported on the front access door 13 of the furnace 10 to be pivotally moveable with the front door 13 about the hinges 14. The burner assembly 15 includes a burner housing 50 that projects forwardly front the front access door 13 and surrounds the components housed therein. The burner housing 50 includes at least two hinged panels 52 that permit access to components within the burner housing 50. In a first compartment 53 of the burner housing 50, a conventional preheater block 54 is supported to receive a flow of used oil from the storage container (not shown) and raise the temperature of the used oil to an acceptable level that facilitates the flow of the used oil through and out of the preheater block 54 to a burner nozzle 55 supported in a second compartment 56 of the burner housing 50.

The longitudinally extending wall 57 separating the first and second compartments 53, 56 of the burner housing 50 supported a fan motor 59 that extends into the first compartment 53 with the preheater block 54. The fan 59 drives the rotation of the combustion air fan 58 that extends into the second compartment 56. The combustion air fan 58 draws a supply of combustion air from outside the burner housing 50 though vent openings 51 in the side of the burner housing 50 and blows the combustion air past the burner nozzle 55 into the combustion chamber 20. The burner nozzle 55 has igniter terminals supported on top of the burner nozzle 55 to provide a spark that ignites the flame created from the flow of atomized used oil emitted by the burner nozzle 55 combined with the flow of combustion air from the fan 58, as is well known in the art.

Figure 12:
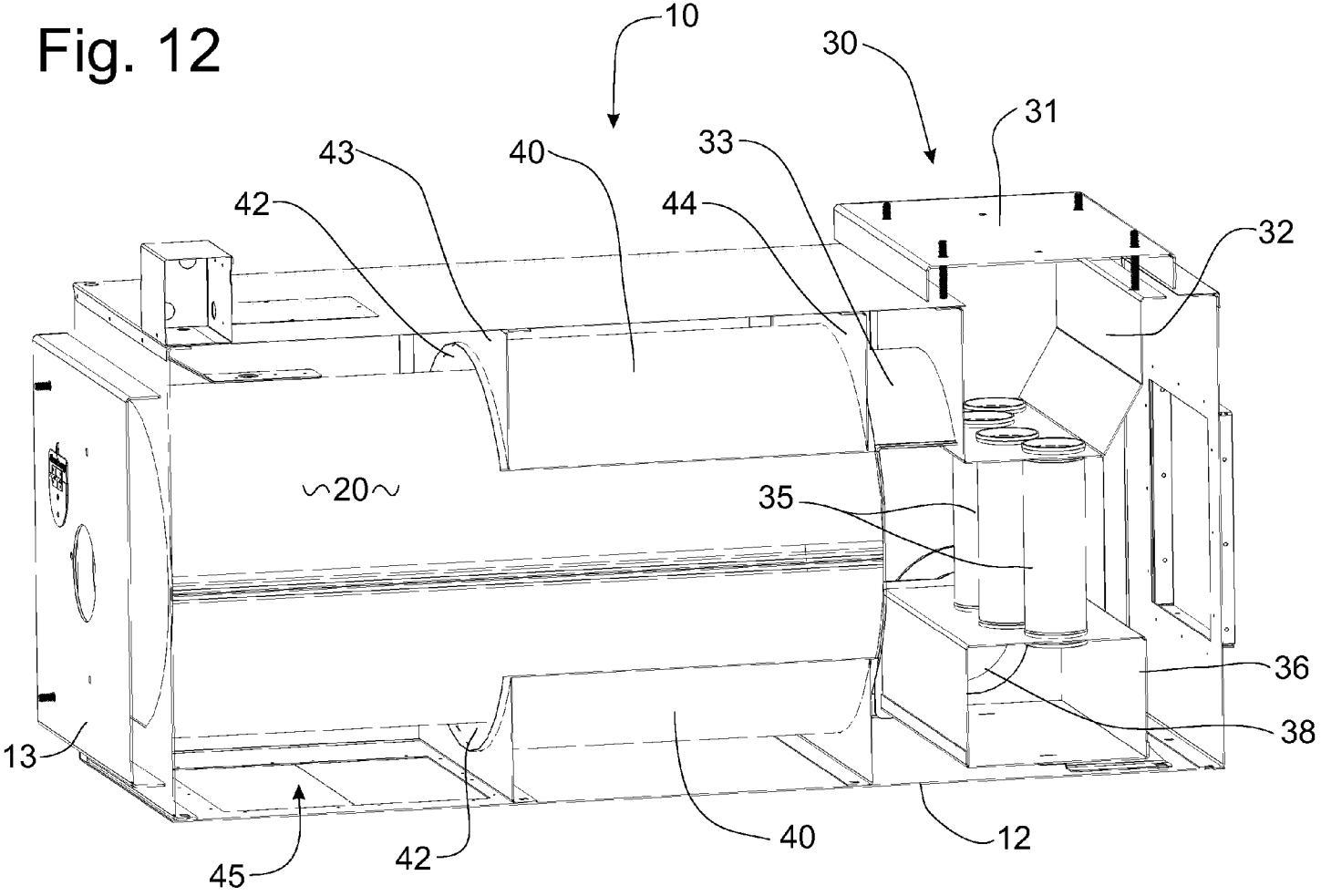
FIG. 12 is a cross-sectional perspective view of an alternative embodiment of the furnace housing taken along a vertical plane extending parallel to the longitudinal axis of the furnace housing, the vertical plane passing through the right side of the furnace housing to depict a different configuration of the vertical flue tube array between the upper and lower headers, the burner assembly and ventilation fans being removed for purposes of clarity.

As can be seen in FIG. 12, the furnace 10 can be configured in different sizes. The furnace 10 in FIG. 12 is configured similarly to the furnace depicted in FIGS. 1-8, except that the heat exchanger 30 is formed with a smaller number of vertical flue tubes 35 in the array extending between the upper header 32 and the lower header 36. The combustion chamber 20 is surrounded by an air sweep shroud 40 covering the rearward portion of said combustion chamber 20 and being separated therefrom by an annular gap forming an annular ring 42 through which the ventilation air blown through the array of vertical flue tubes 35 by the ventilation fan must flow to reach the front ventilation chamber 45 surrounding the forward portion of the combustion chamber 20. Although the burner assembly and the ventilation fan are removed from FIG. 12 for purposes of clarity, the configuration thereof is essentially identical to the corresponding components described above.

In operation, the burner nozzle 55 creates a flame by igniting an atomized flow of used oil emitted from the burner nozzle 55 to be directed at the target 23 mounted on the back wall 22 of the combustion chamber 20. The flame creates hot combustion gases that flow through an exhaust port 33 located at the top of the back wall 22 of the combustion chamber 20 into an upper header 32. The hot combustion gases are then forced to flow downwardly through the array of vertical flue tubes 35 connected to the underside of the upper header 32 to reach the lower header 36 from which the combustion gases can be discharged through the discharge openings 38.

Meanwhile, the ventilation fan 25 blows ventilation air into the cabinet shell 12 into the heat exchanger 30 so that the ventilation air will pass around and through the vertical flue tubes 35 and the flow between the combustion chamber 20 and the air sweep shroud surrounding the rearward portion of the combustion chamber 20. The ventilation air will absorb heat from the combustion gases flowing through the heat exchanger 30 and also heat from the rearward end of the combustion chamber 20. The heated ventilation air exits the annular ring 42 between the air sweep shroud 40 and the combustion chamber 20 into the ventilation chamber 45 where the heated ventilation air can escape the cabinet shell 12 through the ventilation openings 47 into the room in which the furnace 10 is situated.

Cleaning of the heat exchanger 30 can be accomplished through the access door 31 at the top of the cabinet shell 12 over the upper header 32 and through the two transversely opposed discharge openings 38. The access door 31 closes against the top of the upper header 32 so that the upper head is opened for cleaning when the access door 31 is opened. The vertical flue tubes 35 can also be cleaned from the opened access door 31. Most of the ash will be collected in the lower header 36 by virtue of the cooling of the combustion gases from heat transferred to the ventilation air and by virtue of the combustion gases being forced to make a ninety degree turn to move through the opposing discharge openings 38. The lower header 36 can be adequately accessed through the opened discharge openings 38 to allow cleaning thereof.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. The invention is not otherwise limited, except for the recitation of the claims set forth below.

What is claimed is:

1. A furnace for burning petroleum products to produce heat and combustion gases, comprising:

an elongated cabinet shell having a longitudinal axis;

a combustion chamber supported in said cabinet shell within which said petroleum products are burned, said combustion chamber including a front wall and a rear wall;

a heat exchanger mounted within said cabinet shell to receive said combustion gases from said combustion chamber, said heat exchanger including an upper header, a lower header and an array of vertically oriented flue tubes located rearwardly of said rear wall of said combustion chamber, said heat exchanger defining a flow path for said combustion gases that flows through an exhaust port at an upper portion of said combustion chamber into said upper header, then downwardly through said array of vertically oriented flue tubes into said lower header, said cabinet shell including an access door above said upper header to permit selective access into said upper header; and a ventilation fan blowing ventilation air around said vertically oriented flue tubes to extract heat from said combustion gases, said ventilation air being discharged into the ambient atmosphere around said furnace after passing through said heat exchanger.

2. The furnace of claim 1 wherein said vertically oriented flue tubes terminate in said lower header having a discharge opening therein for the discharge of said combustion gases from said cabinet shell.

3. The furnace of claim 2 wherein said ventilation fan is mounted rearwardly of said heat exchanger to blow ventilation air through said array of vertically oriented flue tubes.

4. The furnace of claim 1 wherein said ventilation air is directed over said burner chamber to a ventilation chamber at a forward end of said cabinet shell where heated ventilation air is discharged from said cabinet shell.

5. The furnace of claim 4 wherein said cabinet shell supports a shroud circumferentially surrounding a rearward portion of said combustion chamber, said shroud being spaced from said combustion chamber by an annular gap defining an annular ring around said combustion chamber, said ventilation air passing through said annular ring before reaching said ventilation chamber.

6. The furnace of claim 5 wherein said cabinet shell supports a front wall and a rear wall in which said shroud is mounted, said rear wall blocking said cabinet shell outwardly of said shroud to force all of said ventilation air into a laminar flow through said annular ring between said shroud and said combustion chamber to collect heat from said combustion chamber before flowing into said ventilation chamber.

7. The furnace of claim 6 wherein said ventilation chamber surrounds a forward portion of said combustion chamber, said ventilation chamber including ventilation openings through said cabinet shell for the discharge of said heated ventilation air from said cabinet shell.

8. A used oil furnace comprising:

an exterior cabinet shell having a front wall, a rear wall and a top wall;

a combustion chamber supported in longitudinal alignment within said cabinet shell, said combustion chamber having a rear wall spaced from said front wall of said cabinet shell;

a burner assembly supported on said front wall and including a burner nozzle operable to create a flame within said combustion chamber directed toward said rear wall of said combustion chamber, said flame generating combustion gases within said combustion chamber;

a heat exchanger supported within said cabinet shell and being located rearwardly of said combustion chamber; said heat exchanger including:

an upper header in flow communication with said combustion chamber by an exhaust port to receive combustion gases therefrom;

a lower header spaced below said upper header, said lower header having at least one discharge opening therein for the discharge of combustion gases from said cabinet shell; and an array of vertical flue tubes interconnecting said upper and lower headers to transfer combustion gases from said upper header downwardly to said lower header;

a ventilation fan mounted to blow ventilation air through said heat exchanger to collect heat from said combustion gases flowing through said vertical flue tubes;

an access door in said top wall of said cabinet shell above said upper header to provide access into said upper header and into said vertical flue tubes; and an air sweep shroud supported from said cabinet shell in a spaced orientation from said combustion chamber by a gap to provide a flow path for ventilation air to move against said combustion chamber.

9. The used oil furnace of claim 8 wherein said shroud circumferentially surrounds said combustion chamber and is spaced generally uniformly from said combustion chamber to define an annular ring between said shroud and said combustion chamber for the movement of ventilation air therebetween.

10. The used oil furnace of claim 9 wherein said shroud is supported between a front wall located at an intermediate portion of said combustion chamber and a rear wall proximate to said rear wall of said combustion chamber, said rear wall blocking the movement of said ventilation air through said cabinet shell except to move through said annular ring between said shroud and said combustion chamber.

11. The used oil furnace of claim 10 further comprising a ventilation chamber located around a forward portion of said combustion chamber forwardly of said front wall supporting said shroud, said ventilation chamber including ventilation openings in said cabinet shell for the discharge of ventilation air therefrom.

12. The used oil furnace of claim 11 wherein said exhaust port interconnecting said combustion chamber and said upper header is located at an upper portion of the rear wall of said combustion chamber.

13. The used oil furnace of claim 11 wherein said ventilation fan is mounted on said rear wall of said cabinet shell to blow ventilation air into said heat exchanger.

14. In a used oil furnace having an external cabinet shell; an elongated, cylindrical combustion chamber supported within said cabinet shell and being oriented longitudinally from a front wall and a rear wall for the burning of a flame therewithin to generate heat and combustion gases; and a burner assembly mounted at said front wall of said combustion chamber to generate said flame within said combustion chamber directed toward said rear wall of said combustion chamber, the improvement comprising:

a heat exchanger located rearwardly of said rear wall of said combustion chamber to receive combustion gases from said combustion chamber and to discharge said combustion gases from said heat exchanger and from said cabinet shell;

a ventilation fan mounted on said cabinet shell to blow ventilation air through said heat exchanger to absorb heat from said combustion gases flowing through said heat exchanger and to move said ventilation air past said combustion chamber to a ventilation chamber at a forward end of said cabinet shell; and a cylindrical air sweep shroud surrounding a rearward portion of said combustion chamber and being spaced from said combustion chamber by a gap, said shroud being supported in a front wall and in a rear wall such that said ventilation air is forced to move to said ventilation chamber by passing between said shroud and said combustion chamber to collect additional heat from said combustion chamber before entering said ventilation chamber, said shroud terminating at said front wall, said front wall being positioned intermediate said combustion chamber at said ventilation chamber and extending from said shroud to said cabinet shell to force said ventilation air along a laminar flow circumferentially around said combustion chamber.

15. The used oil furnace of claim 14 wherein said shroud is generally concentric with said combustion chamber so that said gap extends circumferentially around said combustion chamber to define an annular ring.

16. The used oil furnace of claim 15 wherein said heat exchanger includes an array of vertically oriented flue tubes positioned rearwardly of said combustion chamber, said combustion gases being directed through said vertical flue tubes before being discharged from said cabinet shell.

17. The used oil furnace of claim 16 wherein said heat exchanger further includes:

an upper header in flow communication with said combustion chamber through an exhaust port in said rear wall of said combustion chamber, said vertical flue tubes extending downwardly from said upper header; and a lower header receiving said vertical flue tubes, said lower header having at least one discharge opening therein for the discharge of said combustion gases from said cabinet shell.

18. The used oil furnace of claim 17 wherein said ventilation fan is mounted on a rear wall of said cabinet shell to direct a flow of ventilation air through said array of vertical flue tubes to collect heat therefrom before moving into said annular ring around said combustion chamber.

* * * * *